US010869568B2

(12) United States Patent
Hughes

(10) Patent No.: US 10,869,568 B2
(45) Date of Patent: Dec. 22, 2020

(54) SHOE HORN

(71) Applicant: Richard D. Hughes, Denver, CO (US)

(72) Inventor: Richard D. Hughes, Denver, CO (US)

( * ) Notice: Subject to any disclaimer, the term of this patent is extended or adjusted under 35 U.S.C. 154(b) by 85 days.

(21) Appl. No.: 16/285,723

(22) Filed: Feb. 26, 2019

(65) Prior Publication Data

US 2019/0261799 A1 Aug. 29, 2019

Related U.S. Application Data

(60) Provisional application No. 62/636,326, filed on Feb. 28, 2018.

(51) Int. Cl.
*A47G 25/82* (2006.01)

(52) U.S. Cl.
CPC ..... *A47G 25/82* (2013.01)

(58) Field of Classification Search
CPC ..... A47G 25/80–90
USPC ..... D2/641, 642
See application file for complete search history.

(56) References Cited

U.S. PATENT DOCUMENTS 470,109 A * 3/1892 Dickinson ..... D2/642
D45,014 S * 12/1913 Meginn
1,163,399 A * 12/1915 Fox ..... A47G 25/82 223/118
4,290,539 A * 9/1981 Lowery ..... A47G 25/82 223/118
D479,764 S * 9/2003 Fink, Sr. ..... D2/642
D624,727 S * 10/2010 Clemente ..... A47G 25/82 D2/642

FOREIGN PATENT DOCUMENTS

FR 932495 * 3/1948
JP 03000016 A * 1/1991
JP 2011194049 A * 10/2011

* cited by examiner

*Primary Examiner* — Ismael Izaguirre
(74) *Attorney, Agent, or Firm* — Roger A. Jackson

(57) ABSTRACT

A shoe horn that includes a beam having first and opposing second end portions, further included in the shoe horn is an elongated finger having a proximal end portion and an opposing distal end portion, wherein the proximal end portion extends from the first end portion forming an interface such that the beam and finger are substantially parallel, wherein the distal end portion is a free end in the form of a cantilever wherein a channel gap is formed as defined by the beam and the finger and interface. Wherein operationally, the beam inserts into the shoe interior adjacent to a shoe upper sidewall with the interface resting against a sidewall margin to hold the beam in place against the sidewall with the finger being outside a shoe interior, wherein the beam allows a user's foot to slide against the beam into the shoe interior.

2 Claims, 7 Drawing Sheets

SHOE HORN

RELATED APPLICATION

This application claims the benefit of U.S. provisional patent application Ser. No. 62/636,326 filed on Feb. 28, 2018 by Richard D. Hughes of Denver, Colo., U.S.

FIELD OF THE INVENTION

The present invention generally relates to shoe horns for putting on and taking off shoes. More particularly, the present invention discloses a special shoe horn for boots and specifically for cowboy boots.

DESCRIPTION OF THE RELATED ART

Traditional prior art shoe horns are shorter (about four inches long) and are designed for a conventional shoe such as a loafer, dress shoe, derby, oxford, wing tip, boat, brogue, and the like, that all have low rise uppers that terminate below the ankle joint of the wearer. However, for boots, and cowboy boots in particular that have a portion of the upper (known as the shaft) that can extend upward toward around one-half of the distance between the ankle and the knee plus the shaft is typically a stiffer leather as needed to have enough rigidity to freely stand upright from the sole of the boot. Thus the typical construction of the shaft results in little stretching flexibility and a fairly stiff construction, thus making it difficult for a cowboy boot user to insert their foot into the shaft portion toward the bottom of the cowboy boot. Further as a conventional shoe horn is of little use due to the relatively longer upper shaft (as compared to a conventional shoe) due to the conventional shoe horn short length, a lot of cowboy boot owners buy their cowboy boots oversize to more easily get their foot through the shaft, however, resulting in an ill fitting cowboy boot lower (known as a counter, vamp, and toe portions), wherein the lower is then too big allowing the user's foot to move around excessively within the boot lower while walking.

Looking at the shoe horn related prior art in U.S. Pat. No. 6,032,839 to Joosten et al., disclosed is an elastic stocking aid, however, being included for having element 105 (see FIG. 7*b*) that is a notch retainer like the present inventions elongated finger, except that Joosten is in a different location and use as being gripped by the user.

Further, looking at the shoe horn related prior art in U.S. Pat. No. 9,451,843 to Levelle, disclosed is a boot shoe horn that is made of a flexible planar material with a pull handle and wide load area being made of a low friction material, however, not having any of its own rigidity.

Next, looking at the shoe horn related prior art in U.S. Pat. No. 9,326,630 to Showalter, disclosed is an extended length shoe horn that has a clamping mechanism at its lower position to grip the shoe as between the heel outer surface and the heel inner surface to hold the shoe horn in place inside of the heel of the shoe, such that the user does not have to bend over to get their foot into the shoe, wherein the clamping mechanism is actuated by a grasping handle at the upper portion of the extended length show horn.

Continuing, looking at the shoe horn related prior art in U.S. Pat. No. 6,761,292 to Newman, disclosed is a ski boot assist mechanism that operates as a spreader bar to further separate the cuffs of a ski boot thus making easier for the task of inserting an individual's foot into the rigid ski boot.

Moving onward, in the shoe horn related prior art in U.S. Pat. No. 6,065,654 to Evensen, disclosed is a boot shoe horn similar to Levelle in that it is flexible and has a pair of finger holes to remove it from the boot once the individual's foot is in the boot, thus providing a low friction surface as between the individual's sock and the upper liner.

Yet further, in the shoe horn related prior art in U.S. Pat. No. 5,090,140 to Sessa, disclosed is a built in shoe horn for a shoe that has an integral pull tab on the top of the heel upper with a semi rigid counter pocket extending into the heel portion and when not in use the pull tab folds downward to not be obvious.

Also, looking at the shoe horn related prior art in United States Patent Application Publication Number US 2016/0286996 to Cary, disclosed is a ski boot extended length shoe horn with finger pull hole on the upper end, the boot horn is made of a flexible, thin, and low friction material, wherein the shape of the boot horn is a long flat planar strip.

This above gives an idea of the current state of the art in the boot shoe horn arts, wherein references Levelle and Cary had elongated boot shoe horns, wherein Cary has an elongated boot shoe horn with a finger hole pull, but it is flexible and a flat strip, and Levelle is similar being a flexible elongated flat strip with a handle hand pull.

What is needed is a shoe horn that is extended in length and rigid channeled specifically for tall boots that allows a "hands free" boot pull up as the user uses both of their hands to pull up the boot front and back quarters via their respective pull straps such that the boot shoe horn stays in position via a back side hook without being manually held in position within the boot, wherein a conventional shoe horn has to be held and manipulated by a user's hand at all times.

SUMMARY OF INVENTION

Broadly, the present invention is a shoe horn for a shoe that includes a sidewall extending from a sole and terminating in a margin, with the sidewall, sole, and margin defining a shoe interior. The shoe horn includes a beam having a first end portion and an opposing second end portion with a longitudinal axis spanning therebetween, further included in the shoe horn is an elongated finger having a proximal end portion and an opposing distal end portion with a lengthwise axis spanning therebetween, wherein the proximal end portion extends form the first end portion forming an interface such that the lengthwise axis and the longitudinal axis are substantially parallel to one another and the distal end portion is a free end in the form of a cantilever wherein a channel gap is formed as defined by the beam and the finger and interface. Wherein operationally, the beam inserts into the shoe interior adjacent to the shoe sidewall with the interface resting against the margin to hold the beam in place against the sidewall with the finger being outside the shoe interior, wherein the beam allows a user's foot to slide against the beam into the shoe interior.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
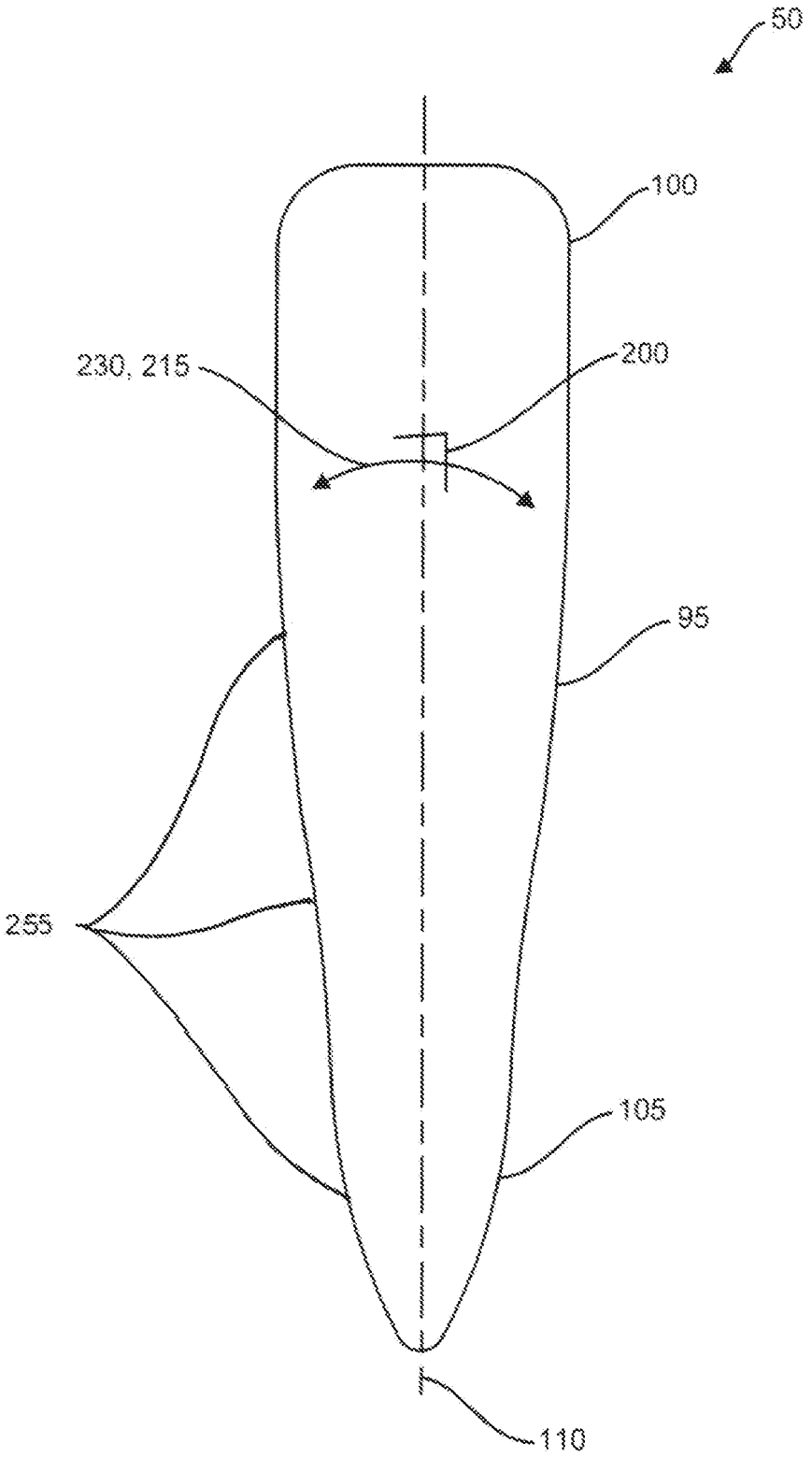
FIG. 1 shows a front elevation view of the shoe horn that includes the beam with the first and second end portions with the longitudinal axis spanning therebetween, plus the first arcuate shape and the concave shape opposite of the finger (hidden in this view)

50 Shoe horn
55 Shoe
60 Sidewall of the shoe 55
65 Sole of the shoe 55
70 Margin of the sidewall 60
71 Pull up loops of the sidewall 60
75 Interior of the shoe 55
80 User
85 Foot of the user 80
86 Movement of the user 80 foot 85
90 Finger of the user 80
95 Beam
100 First end portion of the beam 95
105 Second end portion of the beam 95
110 Longitudinal axis of the beam 95
115 Elongated finger
120 Proximal end portion of the elongated finger 115
125 Distal end portion of the elongated finger 115
130 Lengthwise axis of the elongated finger 115
135 Interface between the proximal end portion 120 and the first end portion 100
140 Parallel position of the lengthwise 130 and longitudinal 110 axes
145 Free end of the distal end portion 125 in the form of a cantilever
150 Channel gap formed between the beam 95, the finger 115, and the interface 135
155 Insert of the beam 95 into the shoe interior 75
160 Beam adjacent to the shoe sidewall 60
165 Interface resting against the margin 70
170 Holding beam 95 in place against the sidewall 60
175 Finger outside the shoe interior 75
180 User foot 85 sliding against the beam 95
185 Protrusion
190 Juxtapose position of the protrusion 185 to the proximal end portion 120
195 Finger grasp of the protrusion 185
200 Movement parallel of the beam 95 to the longitudinal axis 110
205 Insert the beam 95 into the shoe interior 75
210 Remove the beam 95 from the shoe interior 75
215 First arcuate shape of the beam 95
220 Perpendicular position of the first arcuate shape 215 to the longitudinal axis 110
225 Convex surface adjacent to the elongated finger 115
230 Concave shape opposite to the elongated finger 115
235 Elongated second arcuate shape
240 Parallel position of the second arcuate shape 235 to the longitudinal axis 110
245 Concave shape adjacent to the elongated finger 115
250 Convex shape opposite the elongated finger 115
255 Taper inward of the beam 95

DETAILED DESCRIPTION

With initial reference to FIG. 1 shown is a front elevation view of the shoe horn 50 that includes the beam 95 with the first 100 and second 105 end portions with the longitudinal axis 110 spanning therebetween, plus the first arcuate shape 215 and the concave shape 230 opposite of the finger 115 (hidden in this view). Next, FIG. 2 shows a side elevation view of the shoe horn 50 that includes the beam 95 with the first 100 and second 105 end portions with the longitudinal axis 110 spanning therebetween, plus the second elongated arcuate shape 235 and the finger 115 with its lengthwise axis 130 with the interface 135 and the channel gap 150 along with the protrusion 185.

Figure 2:
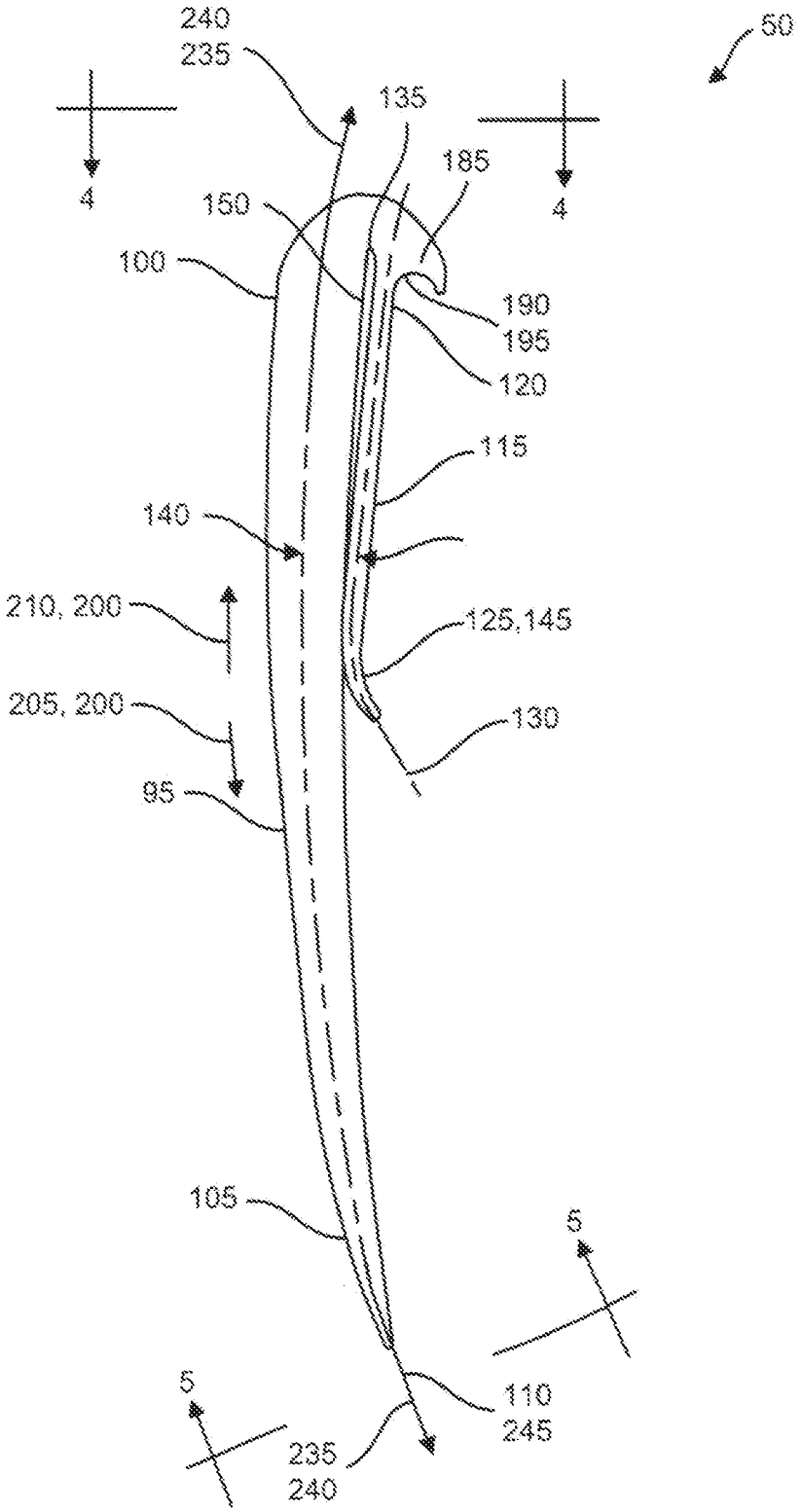
FIG. 2 shows a side elevation view of the shoe horn that includes the beam with the first and second end portions with the longitudinal axis spanning therebetween, plus the second elongated arcuate shape and the finger with its lengthwise axis with the interface and the channel gap along with the protrusion.
Figure 3:
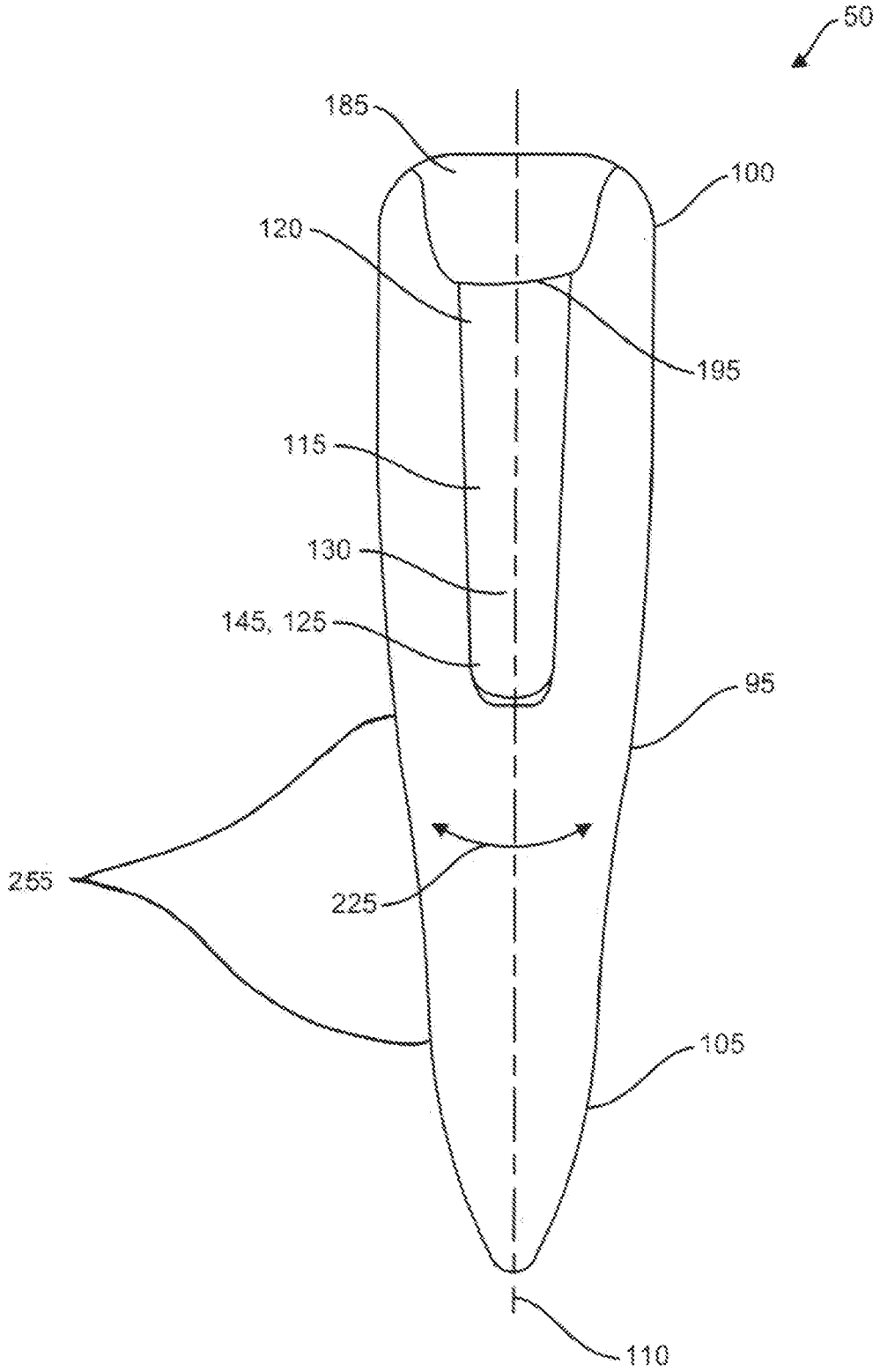
FIG. 3 shows a rear elevation view of the shoe horn that includes the beam with the first and second end portions with the longitudinal axis spanning therebetween, plus the convex surface adjacent to the finger with the protrusion is also shown.
Figure 4:
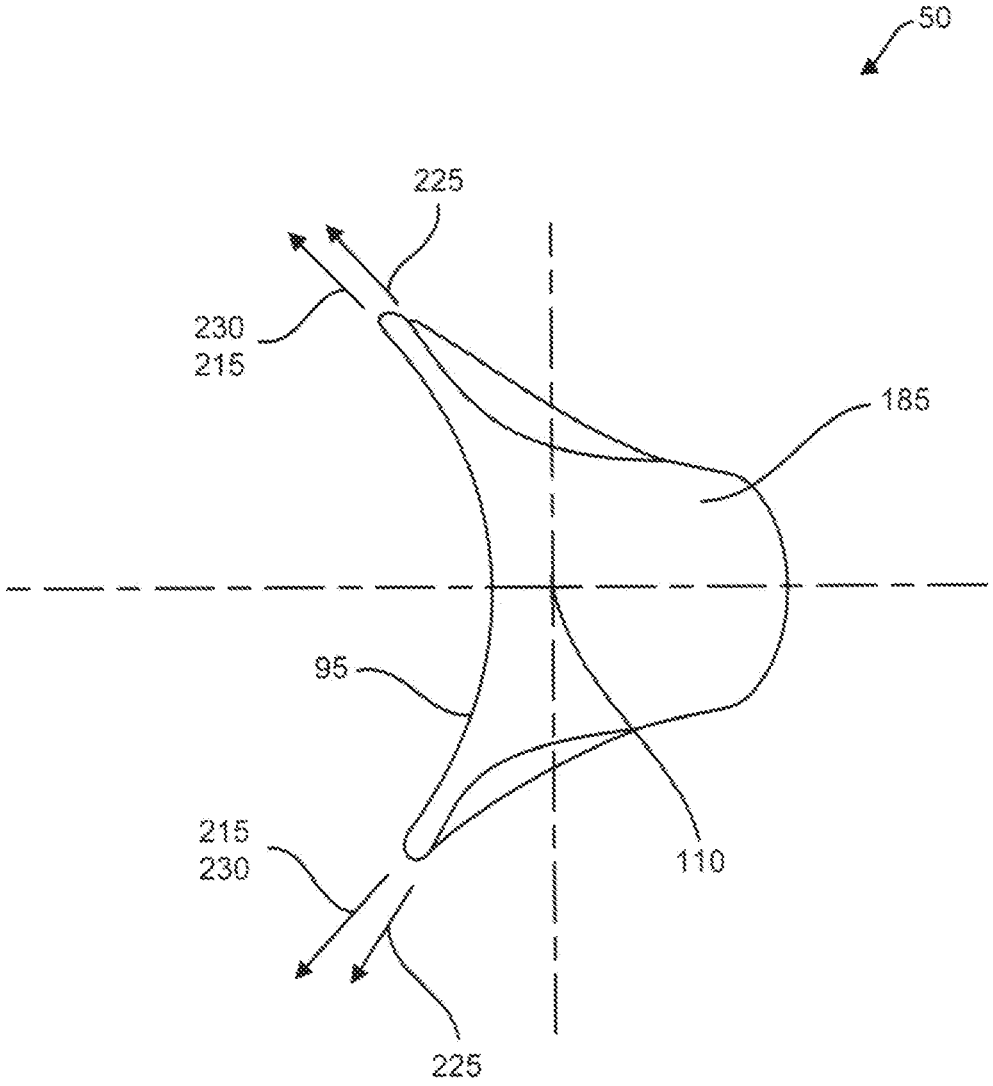
FIG. 4 shows view 4-4 from FIG. 2, wherein FIG. 4 includes the beam, plus the first arcuate shape and the concave shape opposite of the finger (hidden in this view), also the convex shape adjacent to the finger (hidden in this view), and the protrusion with a position of the longitudinal axis.

Continuing, FIG. 3 shows a rear elevation view of the shoe horn 50 that includes the beam 95 with the first 100 and second 105 end portions with the longitudinal axis 110 spanning therebetween, plus the convex surface adjacent 225 to the finger 115 with the protrusion 185 also shown. Further, FIG. 4 shows view 4-4 from FIG. 2, wherein FIG. 4 includes the beam 95, plus the first arcuate shape 215 and the concave shape 230 opposite of the finger 115 (hidden in this view), also the convex shape 225 adjacent to the finger 115 (hidden in this view), and the protrusion 185 with a position of the longitudinal axis 110.

Figure 5:
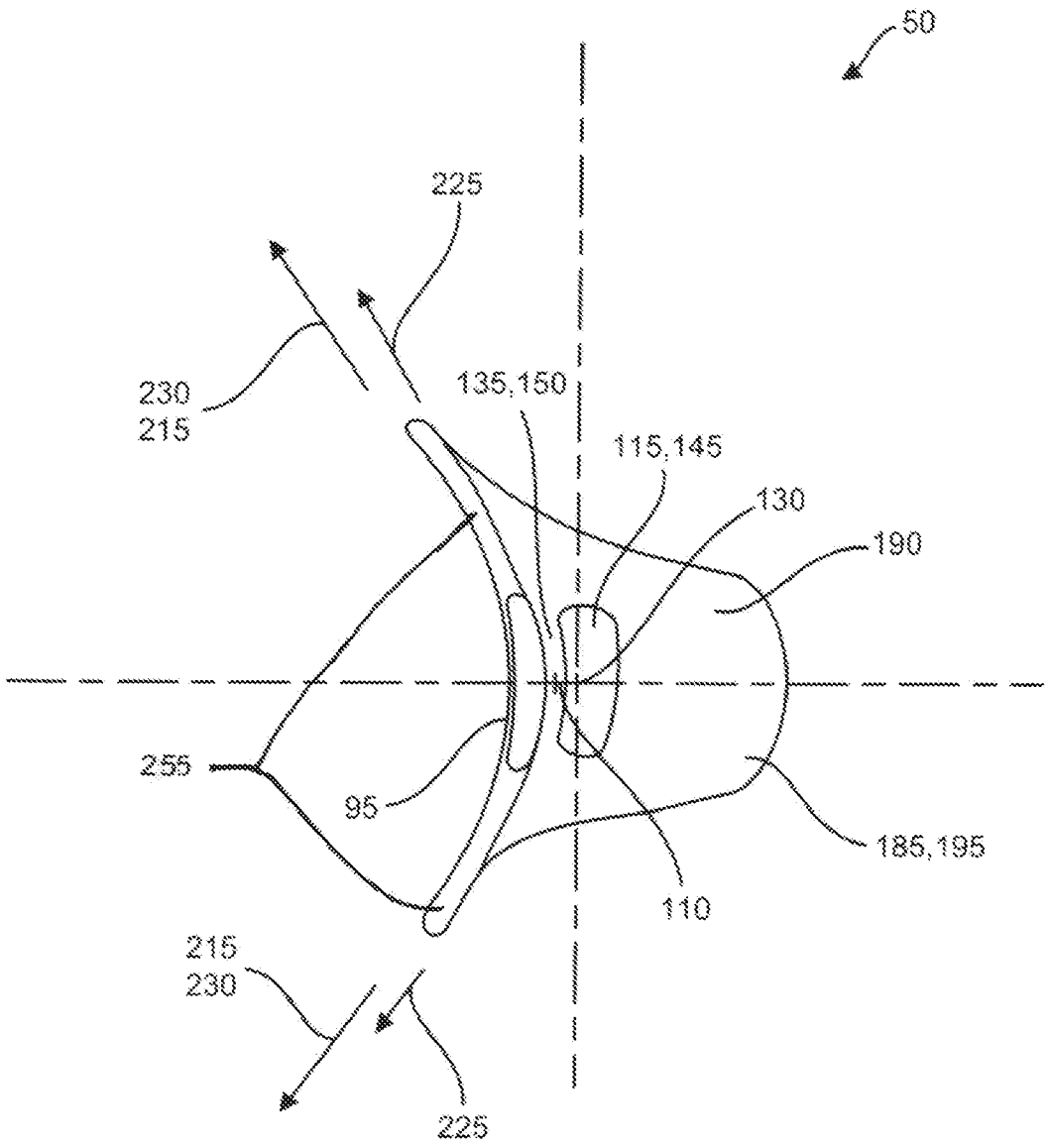
FIG. 5 shows view 5-5 from FIG. 2, wherein FIG. 5 includes the beam, plus the first arcuate shape and the concave shape opposite of the finger, also the convex shape adjacent to the finger, the interface, the channel gap, and the protrusion with its finger grasp, with the position of the longitudinal axis.

Moving onward, FIG. 5 shows view 5-5 from FIG. 2, wherein FIG. 5 includes the beam 95, plus the first arcuate shape 215 and the concave shape 230 opposite of the finger 115, also the convex shape 225 adjacent to the finger 115, the interface 135, the channel gap 150, and the protrusion 185 with its finger 90 grasp 195, with the position of the longitudinal axis 110.

Figure 6:
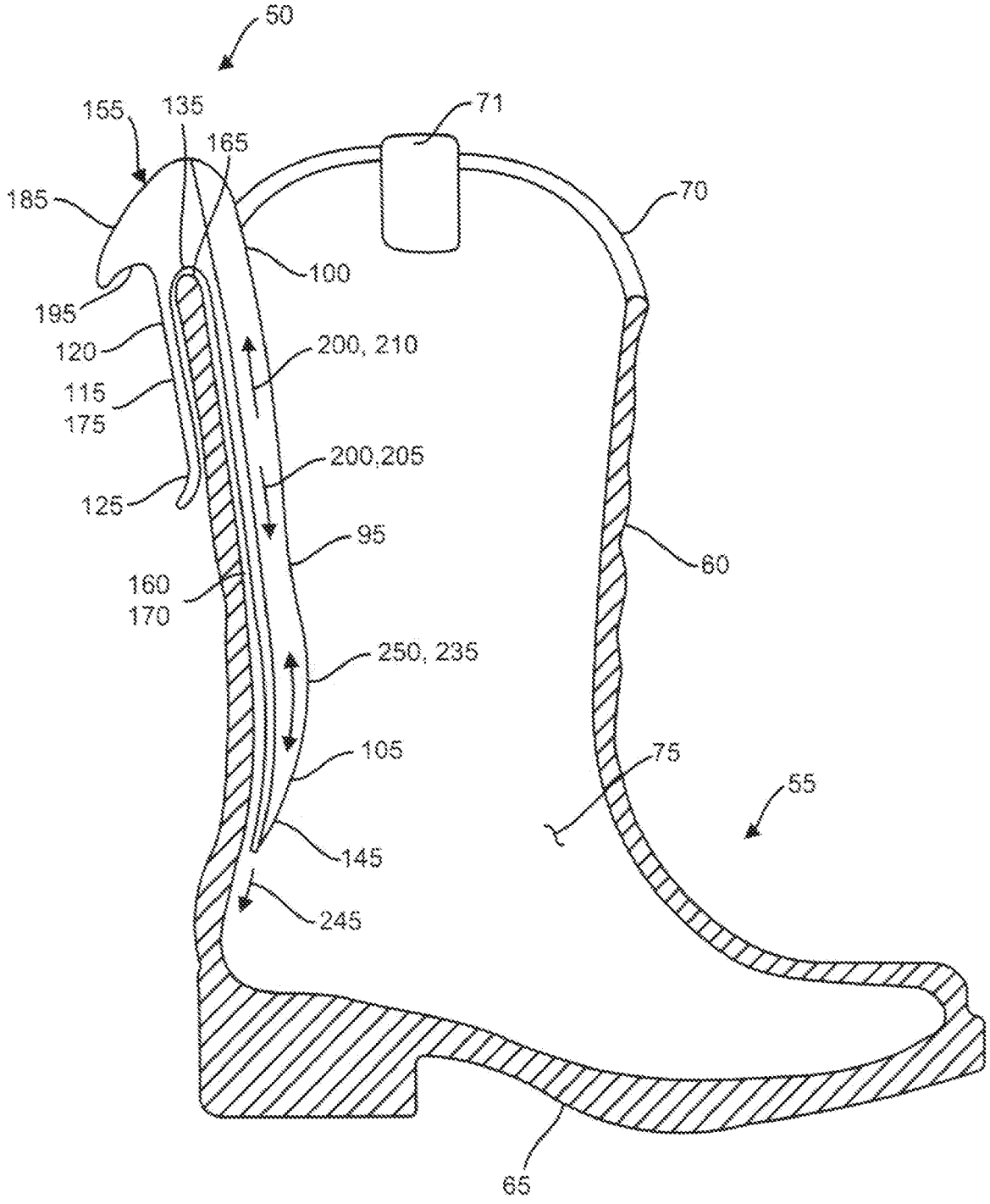
FIG. 6 shows a use drawing with the shoe that includes the sidewall, the margin, the sole, and the interior of the shoe wherein the shoe horn is inserted into position with the beam disposed in the shoe interior with the interface resting against the sidewall margin and the finger resting against the sidewall outside of the shoe interior, thus it is shown that the shoe horn is self securing within the shoe thus leaving the user's hands free to use the sidewall pull up loops that are located at the sidewall margin.

Next, FIG. 6 shows a use drawing with the shoe 55 that includes the sidewall 60, the margin 70, the sole 65, and the interior 75 of the shoe 55, wherein the shoe horn 50 is inserted 205 into position with the beam 95 disposed in the shoe interior 75, with the interface 135 resting against the sidewall 60 margin 70 and the finger 115 resting against the sidewall 60 outside of the shoe interior 75, thus it is shown that the shoe horn 50 is self securing and supporting within the shoe 55 thus leaving the user's 80 hands free to use the sidewall 60 pull up loops 71 that are located at the sidewall 60 near the margin 70.

Figure 7:
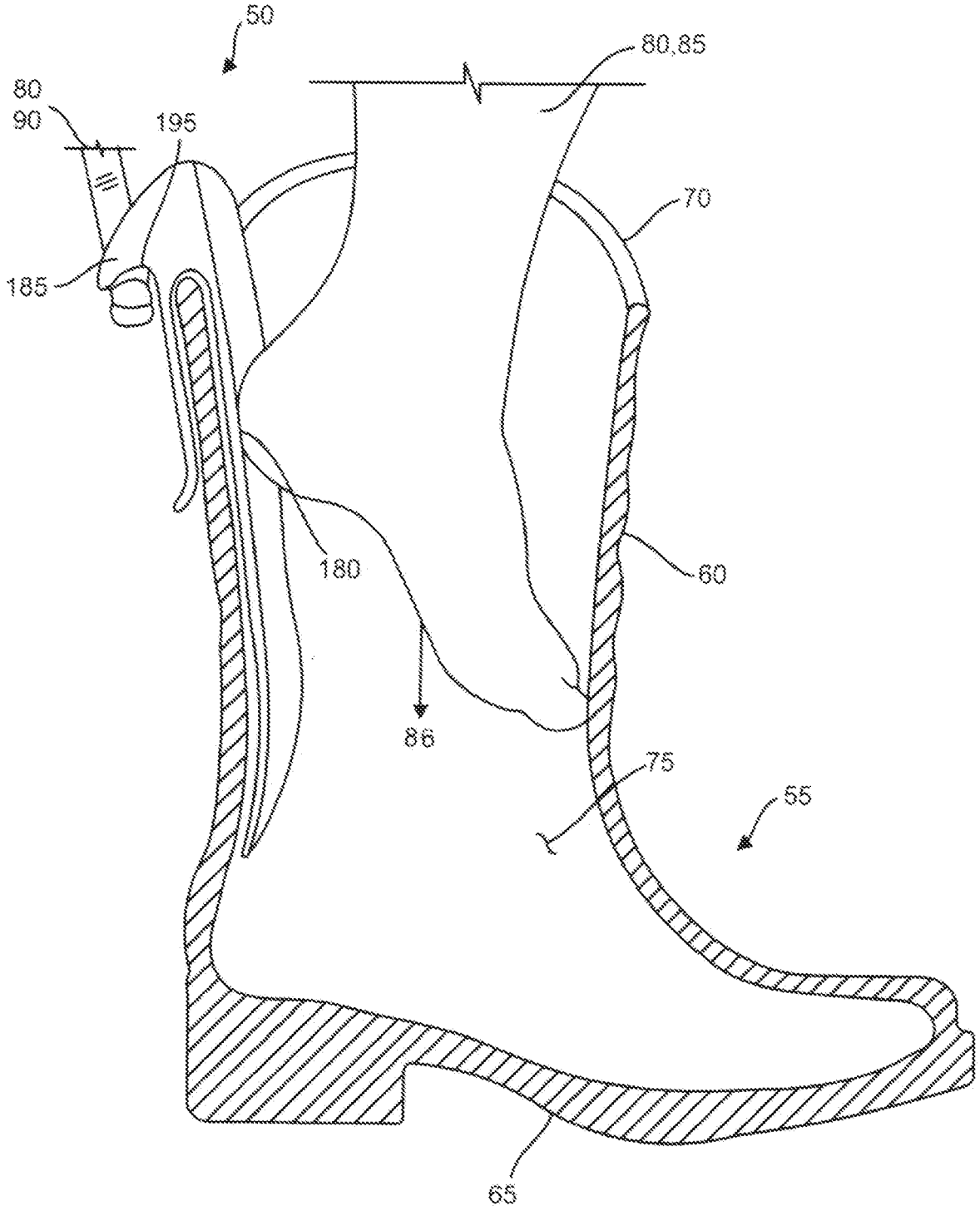
FIG. 7 shows the use drawing of FIG. 6, with FIG. 7 showing the addition of the user's foot using the shoe horn beam elongated second arcuate shape and convex shape opposite the finger, plus first arcuate shape and concave shape opposite of the finger, all to ease the user's foot into the shoe interior, also shown is the protrusion with the finger in place to easily remove the shoe horn from the shoe.

Further, FIG. 7 shows the use drawing of FIG. 6 with FIG. 7 showing the addition of the user's 80 foot 85 using the shoe horn 50 beam 95 elongated second arcuate shape 235 and convex shape 250 opposite the finger 115, plus the first arcuate shape 215 and concave shape 230 opposite of the finger 115, all to ease the user's 80 foot 85 into the shoe interior 75, also shown is the protrusion 185 with the finger 90 in place to easily remove the shoe horn 50 from the shoe 55 after the user's 80 foot 85 is fully inserted 205 into the shoe interior 75.

Broadly, in looking at FIGS. 1 to 5, the present invention is the shoe horn 50 for a shoe 55 that includes the sidewall 60 extending from the sole 65 and terminating in the sidewall 60 margin 70, with the sidewall 60, sole 65, and margin 70 defining the shoe interior 75, as best shown in FIGS. 6 and 7. The shoe horn 50 includes the beam 95 having the first end portion 100 and the opposing second end portion 105 with the longitudinal axis 110 spanning therebetween, see FIGS. 1, 2, and 3, further included in the shoe horn 50 is the elongated finger 115 having the proximal end portion 120 and the opposing distal end portion 125 with the lengthwise axis 130 spanning therebetween, see FIGS. 2, 3, and 5.

Wherein the proximal end portion 120 extends from the first end portion 100 forming the interface 135 such that the lengthwise axis 130 and the longitudinal axis 110 are substantially parallel 140 to one another and the distal end portion 125 is a free end 145 in the form of a cantilever wherein the channel gap 150 is formed as defined by the beam 95 and the finger 115 and interface 135, all as best shown in FIG. 2, also see FIGS. 6 and 7. Wherein operationally, the beam 95 inserts 155, 205 into the shoe interior 75 adjacent 160 to the shoe sidewall 60 with the interface 135 resting 165 against the margin 70 to hold 170 the beam 95 in place against 160 the sidewall 60 with the finger 115 being outside 175 the shoe interior 75, wherein the beam 95 allows a user's 80 foot 85 to slide 180 against the beam 95 into the shoe interior 75, as best shown in FIGS. 6 and 7, wherein the shoe horn 50 is self supported in the shoe 55, allowing the user 80 to use both hands (fingers 90) to pull the pull up loops 71 as used conventionally to put a shoe 55 (cowboy boot) on.

As an option for the shoe horn 50, it can further comprise the protrusion 185 that is juxtapose 190 to the proximal end portion 120 extending from the beam 95 such that the protrusion 185 is operationally adapted to be a finger 90 grasp 195 to slide the beam 95 in a movement 200 parallel to the longitudinal axis 110 to insert 205 and remove 210 the beam 95 and finger 115 from the shoe interior 75, see FIGS. 2, 3, 5, 6, and 7.

Another option for the shoe horn 50, wherein the beam 95 can be formed into the first arcuate shape 215 perpendicular 220 to the longitudinal axis 110 with the convex surface 225 adjacent to the finger 115 and the concave shape 230 opposite the finger 115, see FIGS. 1 to 5.

Yet another option for the shoe horn 50, wherein the beam 95 can further comprise the elongated second arcuate shape 235 that is positioned parallel 240 to the longitudinal axis 110 having the concave shape 245 adjacent to the finger 115 and the convex shape 250 opposite of the finger 115, as best shown in FIGS. 2 and 6.

A further option for the shoe horn 50, wherein the beam 95 first end portion 100 has a taper inward 255 along the longitudinal axis 110 toward the second end portion 105, wherein the taper inward 255 is substantially perpendicular to the first arcuate shape 215 to operationally help center the beam 95 along the longitudinal axis 110 adjacent to the sidewall 60 moving toward the sole 65 within the shoe 55 interior 75 to help a movement 86 of the user 80 foot 85 within the sidewall 60 when sliding the user 80 foot 85 against the beam 95 into the shoe 55 interior 75, see in particular FIGS. 1, 3, 5, and 7.

CONCLUSION

Accordingly, the present invention of a shoe horn has been described with some degree of particularity directed to the embodiments of the present invention. It should be appreciated, though; that the present invention is defined by the following claim construed in light of the prior art so modifications of the changes may be made to the exemplary embodiments of the present invention without departing from the inventive concepts contained therein.

The invention claimed is:

1. A shoe horn for a shoe that includes a sidewall extending from a sole and terminating in a margin, with the sidewall, sole, and margin defining a shoe interior, said shoe horn comprising:

(a) a beam having a first end portion and an opposing second end portion with a longitudinal axis spanning therebetween, wherein said beam first end portion has an adjacent parallel finger, wherein said beam further comprises an elongated second arcuate shape that is positioned parallel to said longitudinal axis having a concave shape adjacent to said finger and a convex shape opposite of said finger, further said beam has a first arcuate shape perpendicular to said longitudinal axis, further, said beam first end portion that has a taper inward along said longitudinal axis toward said second end portion, wherein said taper inward is substantially perpendicular to said first arcuate shape, said taper inward terminates in a pointed shape to operationally help center said beam along said longitudinal axis adjacent to the sidewall moving toward the sole within the shoe interior to help a movement of the user foot within the sidewall when sliding the user foot against said beam into the shoe interior, said finger is elongated having a proximal end portion and an opposing distal end portion with a lengthwise axis spanning therebetween, wherein said proximal end portion extends from said first end portion forming an interface such that said lengthwise axis and said longitudinal axis are substantially parallel to one another and said distal end portion is a free end in the form of a cantilever wherein a channel gap is formed as defined by said beam and said finger and interface, wherein said beam first end portion and said finger proximal end portion both terminate even to one another, further said finger distal end portion terminates at an equidistant midpoint between said beam first and second end portions, wherein operationally said beam inserts into the shoe interior adjacent to the shoe sidewall with said interface resting against the margin to hold said beam in place against the sidewall with said finger being outside the shoe interior, wherein said beam allows a user's foot to slide against the beam into the shoe interior; and (b) a solid protrusion that is juxtapose to said proximal end portion extending from said beam such that said protrusion has an external concave arched surface to operationally facilitate a finger grasp to slide said beam in a movement parallel to said longitudinal axis to insert and remove said beam and said finger from the shoe interior.

2. A shoe horn according to claim 1 wherein said beam said first arcuate shape that is perpendicular to said longitudinal axis has a convex surface adjacent to said finger and a concave shape opposite said finger.

* * * * *